US005190214A

United States Patent [19]

Dewailly

[11] Patent Number: 5,190,214

[45] Date of Patent: Mar. 2, 1993

[54] MAILBOX MESSAGE INDICATION SUPPORT APPARATUS

[76] Inventor: Richard J. Dewailly, 310 Marcia Dr., Luling, La. 70070

[21] Appl. No.: 858,041

[22] Filed: Mar. 26, 1992

[51] Int. Cl.[5] ..... B65D 91/00

[52] U.S. Cl. ..... 232/39; 40/452; 40/574; 40/607; 239/323; 239/284.1

[58] Field of Search ..... 232/38, 39, 17; 40/447, 40/452, 546, 574, 579, 607, 566; 239/323, 104, 284.1

[56] References Cited

U.S. PATENT DOCUMENTS

| | | | |
|---|---|---|---|
| 991,867 | 5/1911 | Mathews | 40/607 |
| 1,407,874 | 2/1922 | Michalski | 40/574 |
| 1,435,379 | 11/1922 | Connery | 40/607 |
| 1,456,982 | 5/1923 | Graham | 40/452 |
| 1,994,186 | 3/1935 | Anderson | 232/39 |
| 1,995,869 | 3/1935 | Sprung | 40/607 |
| 2,229,815 | 1/1941 | Nerbovig | 239/284.1 |
| 2,638,533 | 5/1953 | Zobian | 40/564 |
| 3,672,563 | 6/1972 | McMath | 232/39 |
| 4,588,123 | 5/1986 | Plew | 232/39 |

*Primary Examiner*—Renee S. Luebke
*Assistant Examiner*—Flemming Saether
*Attorney, Agent, or Firm*—Leon Gilden

[57] ABSTRACT

A support member is arranged for the mounting of a mailbox therealong, wherein the support member includes a cementious anchor having a tubular PVC pipe extending upwardly thereof, with the tube member filled with the cementious material mounting a mailbox housing thereon. A modification of the invention includes an indicator housing mounted to the tubular member, with the indicator housing including opposed pivotally mounted doors having apertures directed therethrough to receive opaque plugs, wherein the doors are of a transparent construction and the opaque plugs effect a message through the door structure.

5 Claims, 4 Drawing Sheets

MAILBOX MESSAGE INDICATION SUPPORT APPARATUS

BACKGROUND OF THE INVENTION

1. Field of the Invention

The field of invention relates to mailbox apparatus, and more particularly pertains to a new and improved mailbox support apparatus wherein the same is arranged for the securement and mounting of a mailbox thereon.

2. Description of the Prior Art

Prior art mailbox apparatus is exemplified in the U.S. Pat. Nos. 4,852,847; 4,951,904; and 4,792,088 setting forth various support posts relative to mailbox structures.

Accordingly, it may be appreciated that there continues to be a need for a new and improved mailbox support apparatus as set forth by the instant invention which addresses both the problems of ease of use as well as effectiveness in construction in supporting a mailbox housing resistant to the typical erosion due to rust, abrasion, and the like of support post structure.

SUMMARY OF THE INVENTION

In view of the foregoing disadvantages inherent in the known types of mailbox support apparatus now present in the prior art, the present invention provides a mailbox support apparatus wherein the same is arranged with a PVC pipe including a cementious material directed therethrough mounted at its lower end into a cementious anchor. As such, the general purpose of the present invention, which will be described subsequently in greater detail, is to provide a new and improved mailbox support apparatus which has all the advantages of the prior art mailbox support apparatus and none of the disadvantages.

To attain this, the present invention provides a support member arranged for the mounting of a mailbox therealong, wherein the support member includes a cementious anchor having a tubular PVC pipe extending upwardly thereof, with the tube member filled with the cementious material mounting a mailbox housing thereon. A modification of the invention includes an indicator housing mounted to the tubular member, with the indicator housing including opposed pivotally mounted doors having apertures directed therethrough to receive opaque plugs, wherein the doors are of a transparent construction and the opaque plugs effect a message through the door structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mailbox support apparatus which has all the advantages of the prior art mailbox support apparatus and none of the disadvantages.

It is another object of the present invention to provide a new and improved mailbox support apparatus which may be easily and efficiently manufactured and marketed.

It is a further object of the present invention to provide a new and improved mailbox support apparatus which is of a durable and reliable construction.

An even further object of the present invention is to provide a new and improved mailbox support apparatus which is susceptible of a low cost of manufacture with regard to both materials and labor, and which accordingly is then susceptible of low prices of sale to the consuming public, thereby making such mailbox support apparatus economically available to the buying public.

Still yet another object of the present invention is to provide a new and improved mailbox support apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
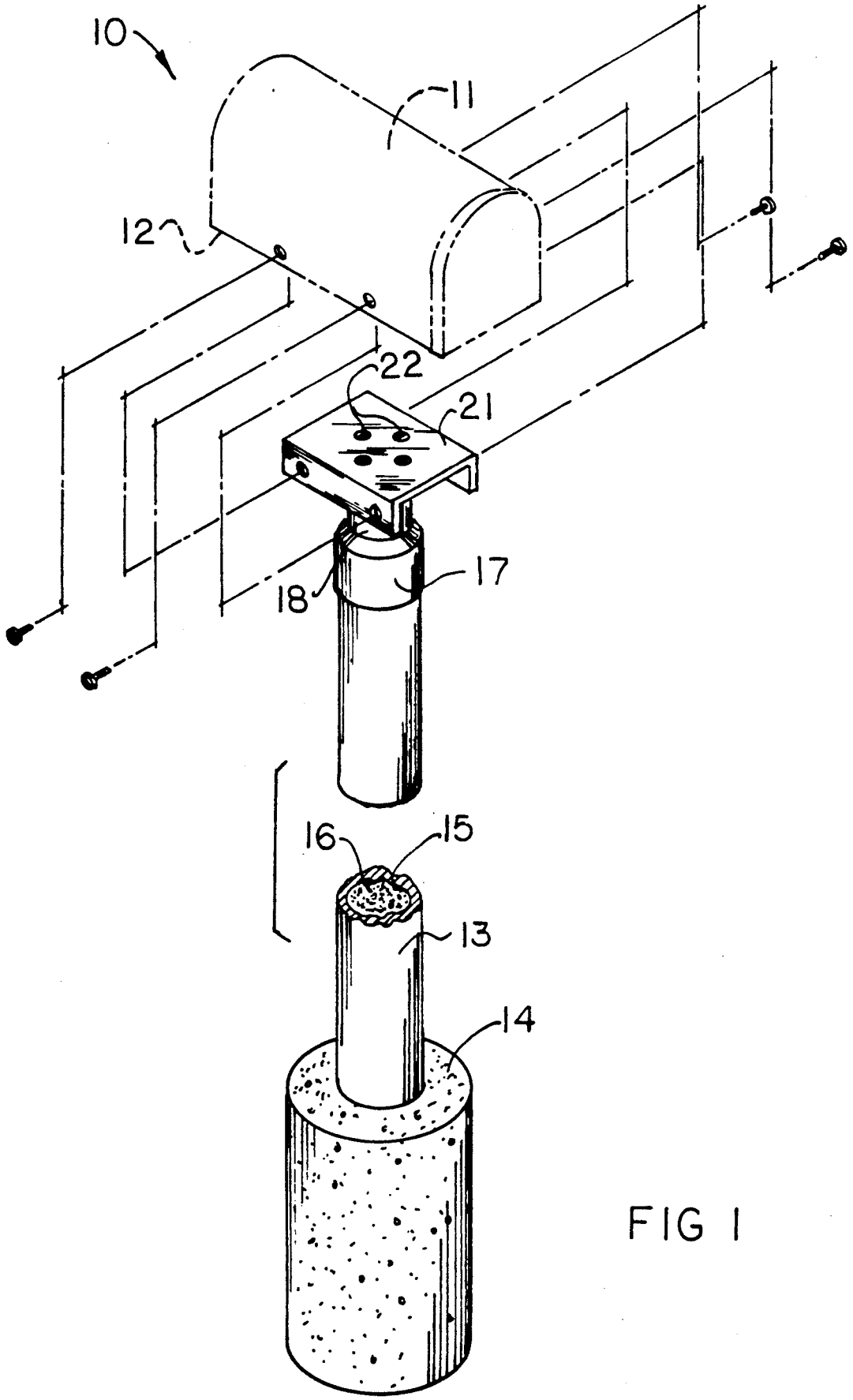
FIG. 1 is an isometric illustration of the instant invention.
Figure 2:
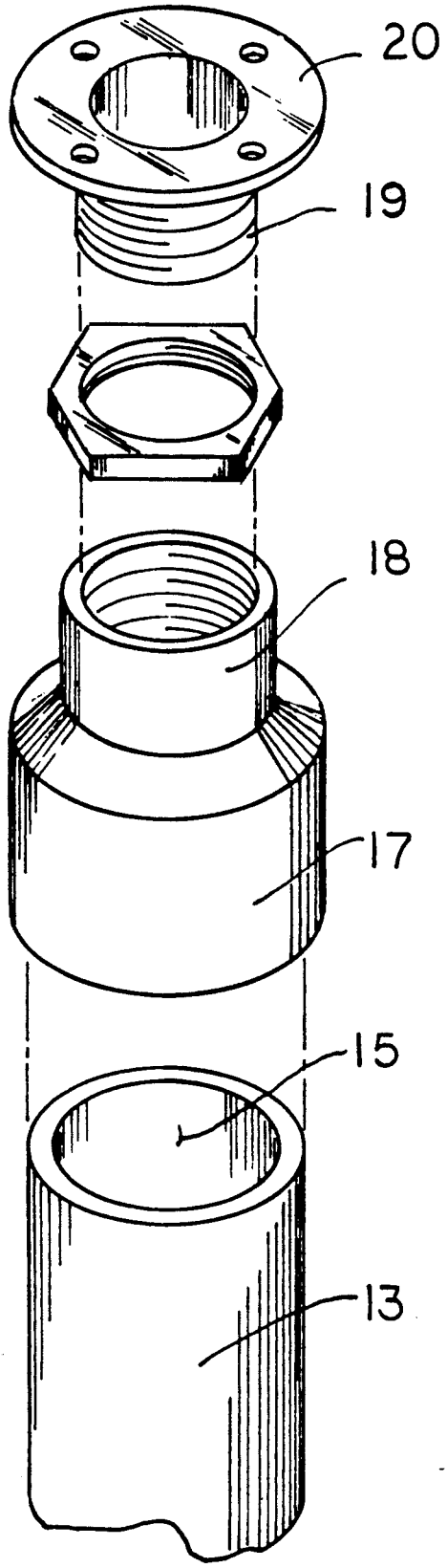
FIG. 2 is an isometric view of the upper portion of the mailbox support post.
Figure 3:
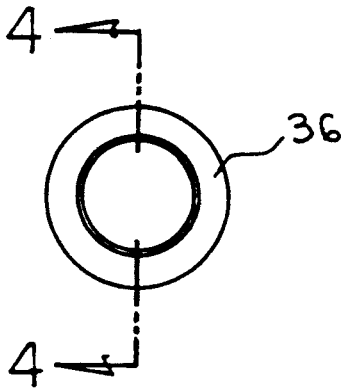
FIG. 3 is an orthographic bottom view of an opaque plug utilized by the invention.
Figure 4:
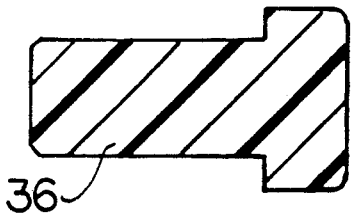
FIG. 4 is an orthographic view, taken along the lines 4—4 of FIG. 3 in the direction indicated by the arrows.
Figure 5:
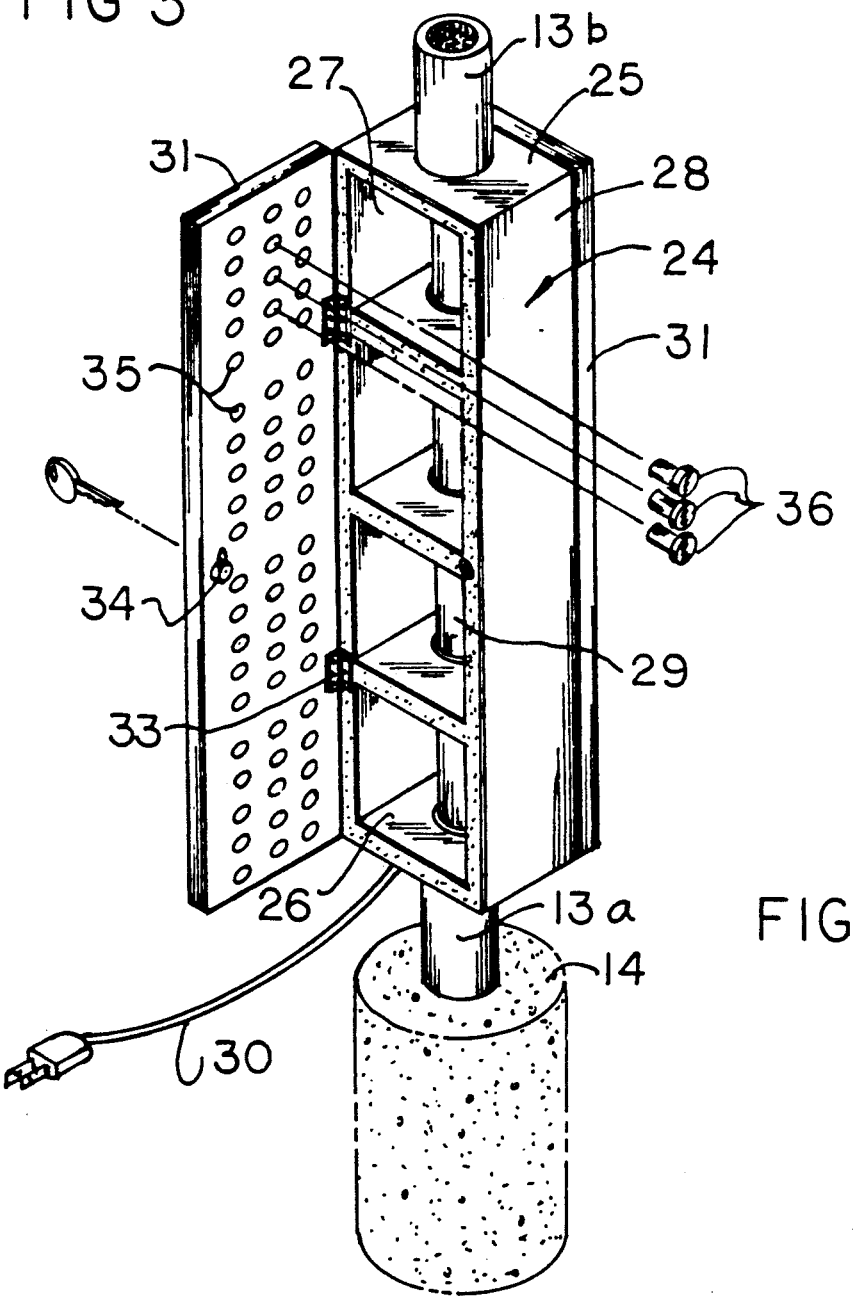
FIG. 5 is an isometric illustration of the invention including an indicator housing mounted longitudinally of the support post.

With reference now to the drawings, and in particular to FIGS. 1 to 7 thereof, a new and improved mailbox support apparatus embodying the principles and concepts of the present invention and generally designated by the reference numeral 10 will be described.

More specifically, the mailbox support apparatus 10 of the instant invention essentially comprises the mounting of a mailbox housing 11 (the mailbox housing including a housing floor 12) upon a polymeric support post 13 of tubular construction formed with an outer first diameter having its lower end received within a cementious anchor 14. The support post includes a support post cavity 15 directed coextensively therethrough receiving a cementious mixture 16 within the cavity 15 coextensively thereof.

The post includes a post cap 17 mounted to an upper distal end of the support post 13, with the support post cap 17 having an inner first diameter equal to the outer first diameter of the post 13 receiving the upper distal end of the post 13 therewithin. A post cap internally threaded extension 18 coaxially aligned relative to the post cap 17 receives an externally threaded plug 19 having a plug flange 20 at its upper distal end, with the plug flange 20 including a mounting plate 21 formed with a plurality of plate fasteners 22 to secure the mounting plate 21 to the plug flange 20. The mounting plate 21 receives the mailbox housing 11 thereon. An internally threaded plug nut member 23 secured about the externally threaded plug 19 is arranged to provide for rotative tightening of the externally threaded plug 19 relative to the internally threaded extension 18.

The apparatus as illustrated in the FIGS. 3-7 is arranged to further include a support post lower end 13*a* spaced from and in coaxial alignment relative to the support post upper end 13*b*. The lower end 13*a* is orthogonally and integrally mounted medially of an indicator housing bottom wall 26, with the post upper end mounted medially and orthogonally of an indicator housing top wall 25. A first side wall 27 is spaced from a second side wall 28. An illumination bulb 29 coaxially aligned between the post lower end 13*a* and the post upper end 13*b* is directed through the indicator housing 24. An electrical power supply 30 is arranged to direct electrical energy into the illumination bulb 29 as required. The indicator housing 24 includes a plurality of transparent doors 31 hingedly mounted about door hinges 33 to opposed longitudinal sides of the indicator housing 24 coextensively between the top wall 25 and the bottom wall 26 on opposed sides of the first and second side walls 27 and 28 arranged in a parallel relationship relative to one another when fastened to the housing 24 by the use of door latches 34, with a door latch 34 mounted to each transparent door 31. A matrix of door apertures 35 are directed through each transparent door 31, wherein a plurality of opaque plugs 36 are arranged for selective reception through a plurality of the matrix of door apertures 35 for the indication of various alpha numeric designations in the transparent door for association with a message or address relative to the apparatus.

Figure 6:
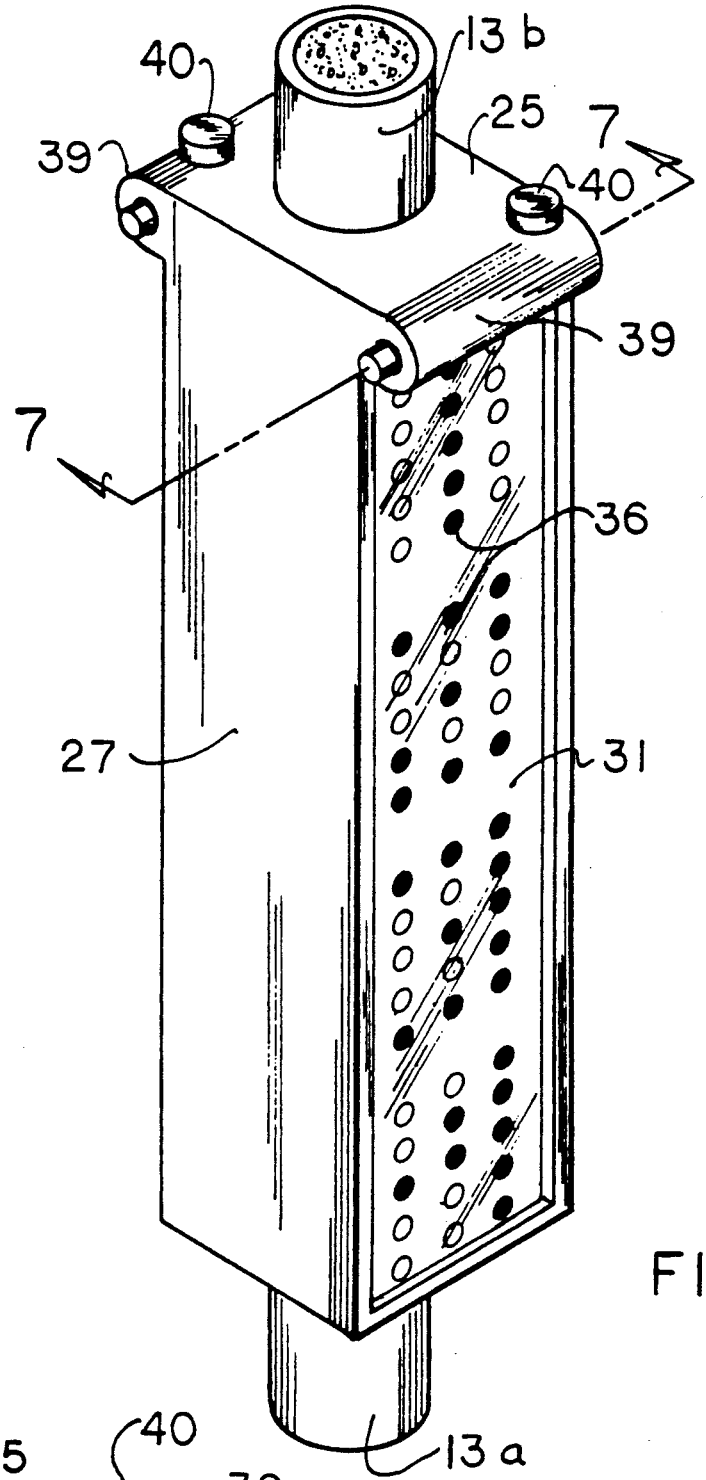
FIG. 6 is an isometric illustration of the indicator housing, including reservoir housings mounted to the indicator housing over the door structures.
Figure 7:
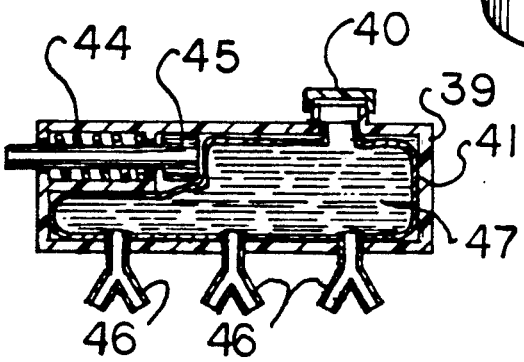
FIG. 7 is an orthographic view, taken along the lines 7—7 of FIG. 6 in the direction indicated by the arrows.

The organization as set forth in the FIGS. 6 and 7 illustrate the use of a reservoir housing 39 arranged in a projecting relationship over each door 31 and formed as an extension of the housing top wall 25. Each reservoir housing 39 includes a fill plug 40 arranged for replenishment of a cleaning solvent fluid 47 within each reservoir housing 39. A flexible bladder 41 is contained within each reservoir housing, wherein a plunger 42 reciprocatably mounted relative to a side wall of the reservoir housing 39 is arranged for projection against the flexible bladder 41. The plunger 42 is arranged in a projecting relationship relative to the reservoir housing by the use of a plunger spring 44 captured between a plunger flange 43 and an interior wall of the housing to bias the plunger in a spaced relationship relative to the reservoir housing 39. Upon projection of the plunger 42 into the reservoir housing 39 against the flexible bladder 41, the fluids 47 contained therewithin is projected through the outlet conduits 46 in fluid communication with the flexible bladder 41 through a bottom wall of the reservoir housing 39, with each of the outlet conduits 46 positioned over a respective door 31 to effect selective cleaning of the door to maintain legible reading of each door in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mailbox support apparatus arranged for receiving a mailbox housing thereon, wherein the apparatus comprises, a polymeric support post, the polymeric support post including an outer first diameter and having a lower distal end and an upper distal end, a cement anchor, the lower distal end received within the cement anchor, and the upper distal end including a post cap mounted thereon, with the post cap including an inner diameter equal to the first diameter, and an internally threaded extension formed to the post cap coaxially aligned therewith extending upwardly thereof, and an externally threaded plug received within the internally threaded extension, and a plug flange mounted to an upper distal end of the plug, and a mounting plate arranged for securement to the flange, and a plurality of plate fasteners securing the mounting plate to the plug flange, with the mounting plate arranged for securement to the mailbox housing, and the support post includes a post lower portion and a support post upper portion, the lower portion coaxially aligned relative to the upper portion in a spaced relationship, and an indicator housing, the indicator housing including a housing bottom wall and a housing top wall, the housing bottom wall fixedly mounted to the support post lower portion fixedly and orthogonally relative to the housing bottom wall, and the housing top wall including the support post upper portion extending upwardly thereof in an orthogonal relationship medially intersecting the housing top wall, and the indicator housing including an illumination bulb extending from the housing top wall to the housing bottom wall coaxially aligned relative to the support post upper portion and the support post lower portion, and the indicator housing including a housing first side wall spaced from a housing second side wall, and a transparent door mounted hingedly to the housing extending from the housing top wall to the housing bottom wall between the housing first side wall and the housing second side wall, and the transparent door including a door latch arranged for securement of the transparent door to the housing, and alpha numeric designation means mounted selectively to the transparent door.

2. An apparatus as set forth in claim 1 wherein the alpha numeric designation means includes the transparent door formed with a matrix of door apertures coextensively of the door from a door upper distal end to a door lower distal end, and a plurality of opaque plugs selectively received within a like plurality of door apertures.

3. An apparatus as set forth in claim 2 wherein the indicator housing includes at least one reservoir housing mounted to the housing top wall projecting beyond the transparent door, the reservoir housing including a fill plug arranged for selective refilling of the reservoir housing, and the reservoir housing including a cleaning fluid contained therewithin, and a flexible bladder contained within the reservoir housing receiving the cleaning fluid, and a plunger slidably mounted through the reservoir housing and projecting exteriorly of the reservoir housing at an outer end of the plunger and an inner end of the plunger arranged in contiguous communication with the flexible bladder.

4. An apparatus as set forth in claim 3 wherein the plunger includes a plunger flange, and the plunger is received within a plunger cavity within the reservoir housing, and the reservoir cavity including a cavity floor, and a plunger spring captured between the plunger flange and the cavity floor arranged to bias the plunger exteriorly of the reservoir housing, and the plunger including a plunger head in contiguous communication with the flexible bladder, the flexible bladder including a plurality of outlet conduits in fluid communication with the flexible bladder and extending through the reservoir housing above the transparent door, whereupon projection of the plunger into the reservoir housing effects projection of cleaning fluid onto the transparent door.

5. An apparatus as set forth in claim 4 including a further transparent door mounted to the indicator housing in a spaced parallel relationship to the transparent door.

* * * * *